US007088212B2

(12) United States Patent
Zannini

(10) Patent No.: US 7,088,212 B2
(45) Date of Patent: Aug. 8, 2006

(54) TRANSFORMER WITH VARIABLE RELUCTANCE

(76) Inventor: Lorenzo Zannini, Via Croce n.58, 42035 Castelnovo Ne Monti (IT)

( * ) Notice: Subject to any disclaimer, the term of this patent is extended or adjusted under 35 U.S.C. 154(b) by 0 days.

(21) Appl. No.: 11/274,593

(22) Filed: Nov. 15, 2005

(65) Prior Publication Data

US 2006/0061447 A1 Mar. 23, 2006

Related U.S. Application Data

(63) Continuation-in-part of application No. 10/653,618, filed on Sep. 3, 2003, now abandoned.

(51) Int. Cl.
*H01F 21/04* (2006.01)
*H01F 17/06* (2006.01)

(52) U.S. Cl. ..... 336/117; 336/234; 336/178

(58) Field of Classification Search ..... 336/119, 336/115, 117, 234, 178
See application file for complete search history.

(56) References Cited

U.S. PATENT DOCUMENTS 4,612,527 A * 9/1986 Third et al. ..... 336/5
6,833,638 B1 * 12/2004 Kang et al. ..... 310/12
2003/0210120 A1 * 11/2003 Sigl ..... 336/198

* cited by examiner

*Primary Examiner*—Anh Mai
(74) *Attorney, Agent, or Firm*—Collard & Roe, P.C.

(57) ABSTRACT

A transformer having variable reluctance, that controls the amount of power conveyed from an input to a load, based on a value selected by a computer control. The load power is varied by controlling the section and air gap between two parallel iron cores and a magnetic reluctance shifter positioned between the cores to vary the magnetic reluctance. The shifter is rotated by a motor. The position of the shifter varies the reluctance of the transformer and thus varies the amount of voltage transmitted from the primary winding to the secondary winding of the transformer. The iron core transformer is mounted in a non-magnetic frame and the windings are made from insulated braided copper strips, or insulated twisted cable.

5 Claims, 3 Drawing Sheets

FIG.1
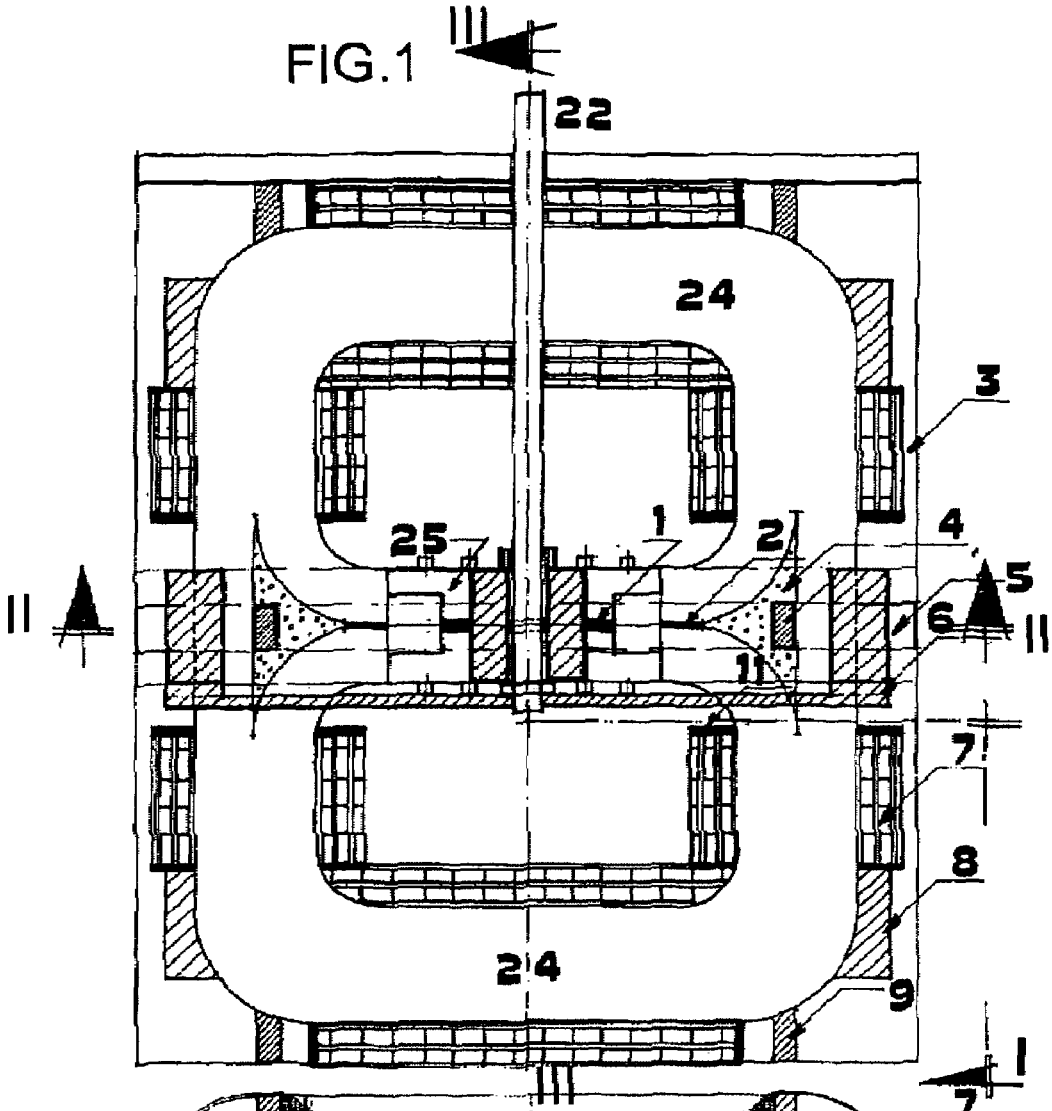
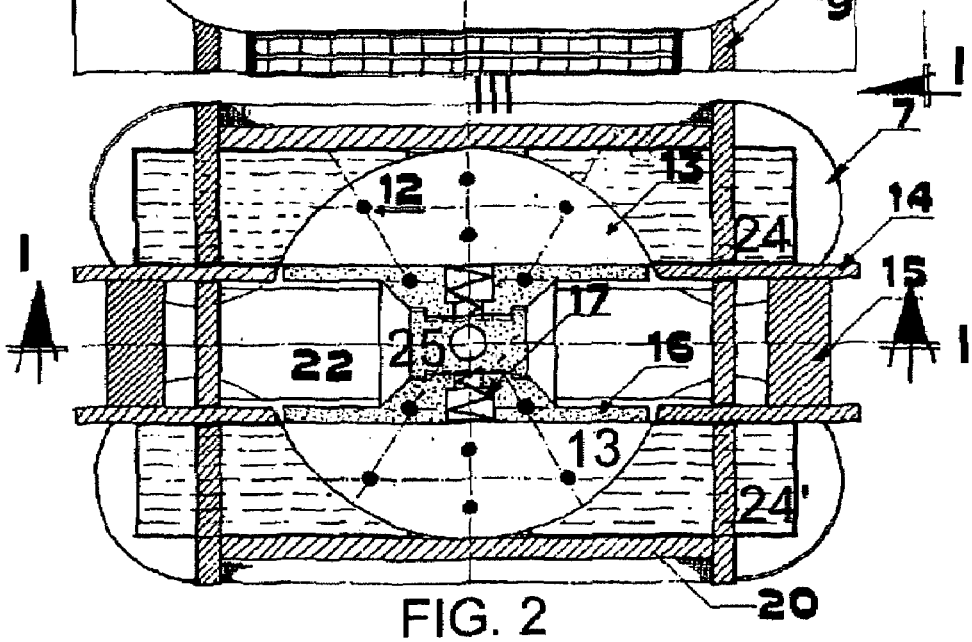
FIG. 2

TRANSFORMER WITH VARIABLE RELUCTANCE

CROSS-REFERENCE TO RELATED APPLICATIONS

This is a continuation-in-part of U.S. patent application Ser. No. 10/653,618, filed on Sep. 3, 2003 now abandoned.

BACKGROUND OF THE INVENTION

The invention relates to a modular transformer that can be used in a power substation for power transmission in the high and medium voltage ranges and in a distribution power panel for low voltage. The transformer utilizes two parallel iron cores with a rotational shifter located between the cores. The position of the shifter determines the amount of voltage reduction between the primary and secondary windings of the transformer.

Several transformers according to the invention can be located in different points of a network transmission line to control the uniform power distribution to the customers. The transformer can be made in different dimensions for a wide range of powers, for a single phase and two phase as well as a three phase system, without limitation of size and dimension, because all components can made by customer design or bought in the market.

SUMMARY OF THE INVENTION

It is an object of the invention to use energy produced by any electric generator (or by public utilities) and to dispense it in the desired optimal quality to the ultimate user plant.

The present invention relates to an electric transformer with a power control output that can be used to operate and control a power reducer. The transformer according to the invention comprises two parallel laminated iron cores with a primary and secondary winding made whit insulated and flexible braided copper strips or twisted cables. The cores are supported in a non-magnetic frame and have a spacer in-between them, to create an air gap between the cores. There is a rotational magnetic shifter mounted between the cores. The shifter is made of iron lamination. The shifter is connected to a shaft and a motor.

Rotation of the shaft by the motor causes the shifter to rotate and vary the position of the shifter and the air gap between the cores. This varies the power reduction between the primary and secondary windings by varying the magnetic reluctance of the transformer. The rotation of the shifter can be programmed according to pre-set parameters.

The transformer according to the invention can be installed through connection bars to the automatic main breakers, in different positions of electric power line, for example:

1—in the middle of high voltage input to the high voltage output.

2—in the middle of high voltage input to the medium voltage output.

3—in the middle of medium voltage input to the low voltage output.

The voltage control power can be used in high and medium voltage, for example:

1)—primary winding from 170,000 to 15,000 volt and secondary winding from 17,000 to 2000 volt, as required by customers, in a single phase or three phases.

2)—primary winding from 17,000 to 2,000 volt and secondary winding to 100 volt or 120, 240; 277; 365; 600, 900 volt; as required by customer, in a single phase or three phases.

The voltage reduction and control stabilization can be achieved in the secondary winding from 1 to 60%, or increase from 1 to 25%. The amperage in the secondary winding in the substation transformer can vary from 50 to 5000 amperes.

The transformer according to the invention simultaneously operates in conjunction with any commercial system for voltage control, current control performance, and power factor correction and can provide not only energy saving and cost reduction and prevent blackouts, but also reduce the power consumption during peak demand periods.

Conventional control power and reducer systems in power plants have been available for many years: by manually reducing voltage to the transmission line by stepping down the input power from 5 to 10%.

In a conventional power reducer system, using a parallel capacitor with variable range of capacitive power, it is possible to automatically control the power factor correction. The system according to the invention can have similar automatic control of power factor correction during the operational time of control and reduction.

When filter networks, surge suppressors and isolation transformers are combined with a voltage regulator such as the transformer according to the invention, the results provide an ideal solution to the power quality transmission line, regardless of whether the connected load is capacitive, resistive or inductive.

The transformer according to the invention will maintain a constant output voltage within +/−1% or better, regardless of input voltage variations from +10% to 20% of the nominal input value. The transformer according to the invention is also designed and rated to meet standard industry Kva ratings for maximum application compatibility with existing installations.

The performance of the transformer according to the invention is guaranteed under all power factor conditions.

The principal advantages of the invention are:

1—automatic voltage output control during peak demand periods

2—redistribution to the users or to electric power substation available from power plant, for high or medium voltage transmission lines.

3—automatic reduction or increasing voltage output for low voltage transmission lines.

4—automatic remote reading system connected to the electronic control device of the transformer can operate data functions storage.

BRIEF DESCRIPTION OF THE DRAWINGS

Other objects and features of the present invention will become apparent from the following detailed description considered in connection with the accompanying drawing.

It is to be understood, however, that the drawing is designed as an illustration only and not as a definition of the limits of the invention.

FIG. 1 shows a schematic view of the system according to the invention in a sectional view along lines I—I of FIG. 2;

FIG. 2 shows a section along lines II—II of FIG. 1;

DETAILED DESCRIPTION OF THE PREFERRED EMBODIMENTS

FIGS. 1 and 2 show schematic drawings showing views of a longitudinal and traversal section of the transformer according to the invention.

Figure 3:
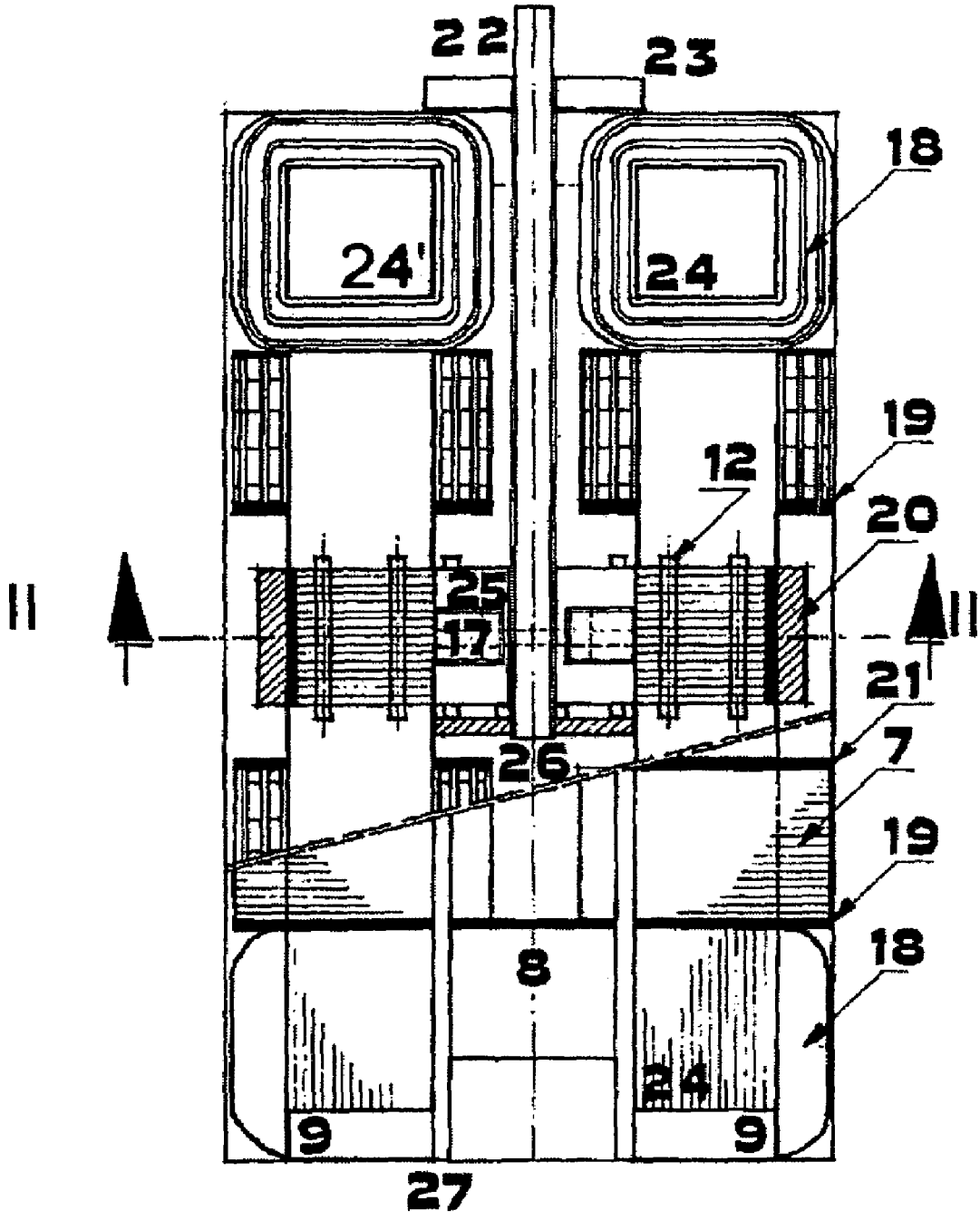
FIG. 3 shows a sectional view along lines III—III of FIG. 1.

The transformer comprises a set of parallel iron cores 24 and 24' (only core 24 can be seen in the view of FIG. 1) surrounded by primary winding 7 and secondary winding 18, (can be seen in the view of FIG. 3). Cores 24 and 24' are connected to external frames 3 and 8 made of non-magnetic material such a PVC or fiberglass. A magnetic shifter 25 is disposed between cores 24 and 24', as shown further in FIG. 2.

There are non-magnetic rectangular blocks 15, acting as armor and spacers of the iron cores 24 and 24'. Shifter 25 is connected to a shaft 22 that controls the rotation of the shifter.

The bar 22 is connected to a motor (not shown). Shifter 25 is comprised of the following components: two semi cylindrical nuclei 13 in overlapped laminated magnetic material, a nucleus support system 16, and a spring 17 that maintains contact pressure between central nuclei 13 and iron core 24.

Between shifter 25 and cores 24 and 24', there are insulation bars 1 and 2 and an interstice with epoxy resin 4, and support slabs 14 and 15, which have the function of support and armor of the semi cylindrical magnetic nuclei 13, as well as a spacer function from the two parallel iron cores 24, 24' of the transformer.

The semi-cylindrical shifter 25 rotates clockwise to reduce the power transmission and counter clockwise to increase the power transmission from the primary to secondary winding.

The principle shifter operation shown in FIG. 2. When the position of shifter 25 is overlapped to the central iron core 24, 24', along lines II—II as shown, shifter 25 is positioned at the maximum reduction of power. If the shifter is in the completely not overlapped position, (perpendicular to II—II), (max. reluctance) there is maximum output voltage.

The condition of maximum flow intensity passage into the central overlapped lamination (shifter parallel to central iron core) is equal to the reduction of 50 to 60% of the maximum load power; and the condition of minimum flow intensity passage (shifter not overlapped to the central iron core) is equal to the maximum nominal power of the transformer.

The rest may be deduced by analogy, because intermediate positions are determined as intermediate reluctance, intermediate power reduction and stabilization, symmetrically to the two parallel iron cores transformers.

FIG. 3 shows a schematic drawing of a longitudinal section along lines III—III of FIG. 1. There is shown a section of iron cores 24, 24' and primary winding 7 and secondary winding 18.

Cylindrical bar 22 is connected to an electric motor support 23, of an electric motor (not shown) which acts to rotate shaft 22 and subsequently shifter 25 via support bar 26.

Shifter 25 closes the magnetic lamination by rotating, to vary the voltage output in secondary winding 18. The electric motor support 23 is connected to the external frame 3 and 27 through the external armor 19 and support slab 14.

Figure 4:
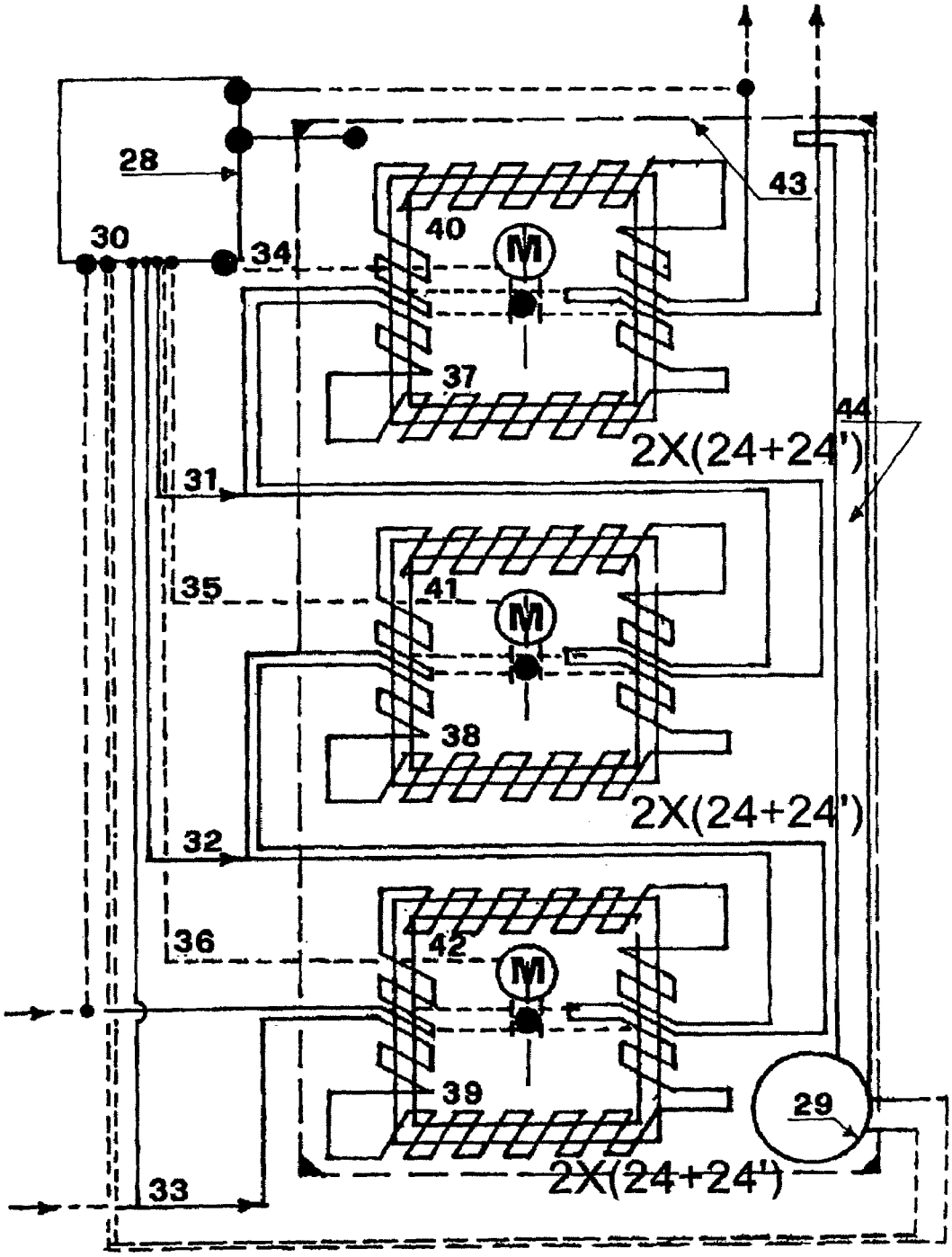
FIG. 4 shows a schematic view of a series connection of the invention.

FIG. 4 is a schematic diagram illustrating hardware elements of the system according to the invention. In this arrangement, there are three coupled transformers. The rotation of each shifter 25 is controlled via microprocessor control 28.

There is a hydraulic cooling oil pump 29 controlled by a drive pump 30, connected to the microprocessor system, for cooling the system. Each transformer in the system has a voltmeter control 31, 32, 33 electric motors operating by mechanical connections 23 to shifter 25 of each transformer. The system can be equipped with safety snap-acting limit switches (not shown), external to the cooling oil metal enclosure 43, which define the rotational limit position of the magnetic reluctance shifter 25.

The transformer includes the group of primary windings in series 37,38,39, and secondary windings in series 40,41, 42, for each iron core 24. The windings are preferably comprised of braided copper strips, and the number, position, overlapped wiring, square section of braided copper strips, and related dimensions of the iron core, frame and support, spacing insulation electric motor power, shifter dimensions, and metal enclosure, radiator, oil pump, etc. . . ., are not described here and vary by the user's requirements. The transformer is enclosed in a metal enclosure 43 with cooling oil.

There is a radiator 44 with external components 28, 29,30,31,33,34,35,36. The transformer is controlled via remote control 28 which is operated by a microprocessor board with a software program. The system of the coupled transformer inside the metal enclosure 43, which is filled with mineral oil, is cooled by hydraulic pump 29 connected to a ventilated heat dispenser. The control 30 of pump 29 is achieved by heating sensors controlled with an electronic system 28.

Many different configurations of the windings are possible within the scope of the invention. In FIG. 4, the primary and secondary windings are made with three windings each in series, positioned around cores 24, 24'.

Other arrangements are possible as well, such as:

1—Primary and secondary winding not overlapped in a symmetrical position around the iron cores: The variation in voltage is achieved by ratio transformation, (V1/V20) and wire ratio: (number of turns in primary winding divided by number of turns in secondary winding);

For example: primary winding: input 16,000 volt: =(V1) secondary winding: (5,000+35%; or 2,500+35%; or 277+35%; or 120+35%; or 100+35% volt). When the shifter overlaps the cores, the following is achieved: output voltage (V20)=(2,500; or 1,250; or 138 or 60; or 50 volts).

2—Primary winding partially overlapped to secondary winding, partially positioned in a symmetrical position around the iron core and the remaining windings in symmetrical and separate iron core position. The voltage variation is achieved by constant transformation and shifter variation (shifter reluctance variation);

For example: primary winding: input 16,000 volt: =(V1) secondary winding partially overlapped: (3,000; or 1,500; or 200; or 100 volt); plus separate winding not overlapped (2,000+35%; or 1,000+35%; or 177+35%; or 20+35% volt). When the shifter overlaps the cores the following is achieved: output voltage (V20)=(2,500; or 1,250; or 138; or 60; or 50 volts).

3—Primary winding overlapped to the secondary winding, separate in two, three, four, five or six windings in symmetrical position around the iron core. The voltage variation is achieved by ratio transformation and shifter variation.

For example: primary winding: input 16,000 volt:=(V1) separate secondary winding (5,000; or 2500; or 277; or 120; or 100 volts). When the shifter overlaps the cores, the following is achieved: output voltage (V20)=(2,500; or 1,250; or 138; or 60; or 50 volts).

The three above described winding scenarios will achieve different combinations if connected in series.

Accordingly, while only a few embodiments have been shown and described, many variations can be made thereunto without departing from the spirit and scope of the invention.

LIST OF REFERENCE NUMERALS

1—Insulation bar in PVC reinforced with insulating glass fibers, or other non magnetic material.
2—Insulation bar interposed from parallel laminated iron core
3—External frame in PVC reinforced with insulating glass fibers, or other non magnetic material
4—Interstice closed with epoxy resin.
5—Central bar of shifter.
6—Central bar for support of the shifter.
7—Primary or secondary winding, in braided copper strips, or twisted cable
8—External frame in non magnetic material.
9—Base of transformer
10—Connection bar from two laminated iron core nucleus
12—Screw closing the shifter the magnetic overlapped lamination
13—Semi-cylindrical nucleus of shifter in magnetic material, formed from overlapped lamination.
14—Slab of support and armor of semi-cylindrical magnetic nuclei with spacer function in non-magnetic material.
15—Rectangular block with function of armor and insulator spacer in non-magnetic material.
16—Semi-cylindrical support system for variation of the magnetic reluctance
17—Spring for the maintenance of the contact between shifter and laminated iron core.
18—Primary or Secondary winding in braided copper strips, or twisted cable
19—External armor of closing winding in insulated material (insulator spacer)
20—Bar in PVC for closing shifter
22—Shaft of the electric motor.
23—Support bar of the electric motor
24, 24'—Magnetic laminated iron core
25—Socket of positioning for the spring between iron core and shifter of reluctance.
26—Central support bar of the shifter.
27—External support in non-magnetic material for semi-cylindrical magnetic nuclei of shifter.
28—Computer Control
29—Hydraulic Pump for oil cooling
30—Sensor for drive pump
31-32-33—Voltmeter connection for each transformer
34-35-36—Sensor for drive motor
37-38-39—Group of three primary windings in series for each nucleus
40-41-42—Group of three secondary windings in series for each nucleus
43—Metallic enclosure for cooling oil
44—Forced air radiator for cooling oil or ventilated heat dispenser.

What is claimed is:

1. A transformer for controlling voltage output, comprising:

two parallel laminated iron cores, positioned with an insulated spacer and an air gap between them;

a primary winding wound around one of said cores;

a secondary winding wound around the other of said cores;

a movable magnetic shifter positioned between the two cores, said shifter being made of laminated iron comprised of two semi-circular magnetic nuclei connected to supports;

springs holding the shifter in position between the iron cores:

a motor connected to the shifter for moving the shifter between a position where the shifter overlaps the cores, and a position where the shifter is not overlapping the cores; and a programmable control connected to the motor to control the motion of the shifter;

wherein when the shifter overlaps the cores, power transmission from the primary winding to the secondary winding is at a minimum level and the magnetic reluctance is at a maximum, wherein when the shifter is not overlapping the cores, if positioned perpendicular to a surface of said cores, power transmission from the primary winding to the secondary winding increases to a maximum level and the magnetic reluctance is at a maximum.

2. The transformer according to claim 1, wherein the cores are mounted in a non-magnetic frame and the windings are made from insulated braided copper strips, or insulated twisted cable.

3. The transformer according to claim 1, wherein the primary and secondary windings do not overlap and are positioned symmetrically around the iron cores.

4. The transformer according to claim 1, wherein the primary and secondary windings partially overlap each other and are positioned symmetrically around the iron cores and further comprising an additional winding positioned symmetrically around the cores.

5. The transformer according to claim 1, wherein there are between two and six primary windings and between two and six secondary windings, each of said primary windings overlapping a secondary winding and said windings being positioned symmetrically around the iron cores.

* * * * *